US006655291B2

(12) United States Patent
Pratt et al.

(10) Patent No.: US 6,655,291 B2
(45) Date of Patent: Dec. 2, 2003

(54) SHAPED-CHARGE LINER

(75) Inventors: Dan W. Pratt, Fort Worth, TX (US); David S. Wesson, DeSoto, TX (US); John K. Rouse, Weatherford, TX (US)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 10/083,721

(22) Filed: Feb. 26, 2002

(65) Prior Publication Data

US 2002/0162474 A1 Nov. 7, 2002

Related U.S. Application Data

(63) Continuation of application No. 09/295,685, filed on Apr. 21, 1999, now Pat. No. 6,354,219.
(60) Provisional application No. 60/083,931, filed on May 1, 1998.

(51) Int. Cl.[7] ..... F42B 1/02
(52) U.S. Cl. ..... 102/307; 102/476
(58) Field of Search ..... 102/307, 476

(56) References Cited

U.S. PATENT DOCUMENTS 4,519,313 A * 5/1985 Leidel ..... 102/310
4,858,531 A * 8/1989 Lindstadt et al. ..... 102/307
5,119,729 A * 6/1992 Nguyen ..... 102/307
5,279,228 A * 1/1994 Ayer ..... 102/306
5,523,048 A * 6/1996 Stinson et al. ..... 102/473
5,567,906 A * 10/1996 Reese et al. ..... 102/307
5,656,791 A * 8/1997 Reese et al. ..... 102/307
5,939,664 A * 8/1999 Kapoor ..... 102/307
6,152,040 A * 11/2000 Riley et al. ..... 102/307
6,354,219 B1 * 3/2002 Pratt et al. ..... 102/307

FOREIGN PATENT DOCUMENTS

FR 2429990 1/1980

OTHER PUBLICATIONS

US 6,470,804, 10/2002, Liedel et al. (withdrawn)*

* cited by examiner

*Primary Examiner*—Peter A. Nelson
(74) *Attorney, Agent, or Firm*—Madan, Mossman & Sriram, P.C.

(57) ABSTRACT

A liner for a explosive shaped charge, such as those used in perforating operations in oil and gas wells, is formed from a powdered metal mixture that includes molybdenum. The molybdenum allows a higher density liner to be formed to create denser jets for achieving deeper penetration, but without the negative effect that often accompany the use of higher density materials. The molybdenum may be used in the amount of 0.5% to 25% by weight of the metal mixture, with tungsten and other constituents forming the remainder of the mixture.

15 Claims, 2 Drawing Sheets

SHAPED-CHARGE LINER

CROSS REFERENCE TO RELATED APPLICATION

This application is a continuation of U.S. patent application Ser. No. 09/295,685 filed Apr. 21, 1999 and now U.S. Pat. No. 6,354,219, benefit is herein claimed of the filing date under 35 U.S.C. §§119 and/or 120, and 37 CFR §1.78 to U.S. Provisional Application Serial No. 60/083,931, filed on May 1, 1998, entitled "Shaped-Charge Liner".

Benefit is herein claimed of the filing date under 35 U.S.C. §§119 and/or 120, and 37 CFR §1.78 to U.S. Provisional Application Serial No. 60/083.931, filed on May 1, 1996, entitled "Shaped-Charge Liner",

BACKGROUND OF THE INVENTION

1. Field of the Invention

This invention relates to shaped explosive charges, and in particular to a liner material used in shaped charges, such as those used in oil and gas wells.

2. Description of the Prior Art

Shaped charges for use in oil and gas well perforation and retrieval operations typically will consist of a casing which houses a quantity of explosive and a liner formed from a compressed-powder metal mixture. Materials used for such liners are well known and include copper, graphite, tungsten, lead, nickel and tin. The purpose of these metals is to allow a reasonably homogeneous mixture with specific properties. When formed under load into a liner, the density and symmetry of the liar can be controlled. By varying the material components, i.e. the material percentages in the matrix, the performance can be controlled.

Over the last few years, the tendency has been to use increasing amounts of tungsten (W) in the mixture to achieve higher density jets that penetrate deeper. One of the problems, however, with these denser powdered metal mixes, is the tendency to cause "slugging", or blockage of the perforation tunnel. This slugging limits the flow of hydrocarbons through the perforation tunnel and into the well bore for recovery. Slugging is attributed to a re-agglomeration of some of the liner materials during the formation of the jet. This can be from the jet itself or the after-jet, known a "slug" or "carrot." The higher the density of the liner the more the likelihood of this phenomenon occurring. Therefore those mixtures with highest amounts of wolfram and other high density metals tend to produce the most slugging.

What is therefore needed is a liner material for a shaped charge with a high density to achieve maximum formation penetration, yet which reduces or eliminates those problems associated with prior art liner materials, such as slugging.

SUMMARY OF THE INVENTION

An object of the present invention is therefore to provide a means of making a high density charge lining without the disadvantages of slug formation.

Another object of the present invention is to provided a charge liner material comprising at least molybdenum (Mo) and other materials of higher density such as tungsten (W).

Yet another object of the present invention in to provide an improved shaped-charge for forming perforations in a wellbore.

These objects are achieved by providing a liner material for use in a shaped explosive charges, such as those used in oil and gas wells for perforating formations surrounding the borehole of the well. The liner material is formed from a powdered metal mixture that contains molybdenum. The metal mixture may further contain tungsten and other powdered metals. In one embodiment the liner material contains an amount of molybdenum of between about 0.5% to 25% by weight of the metal mixture, with tungsten making up between about 40% to 85% by weight of the metal mixture. The mixture may also contain graphite.

The liner may be formed in a shaped charge having a casing The casing has a casing wall and a hollow interior. The liner is positioned within the interior of the casing, and an explosive material is disposed within the interior of the casing between the casing wall and the liner. The liner may be formed in a generally conical configuration.

Additional objects, features and advantages will be apparent in the written description which follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

When the explosive in a perforating gun is detonated, the force of the detonation Collapses the liner material and ejects it from one end of the charge. The ejected material is a "jet", which penetrates the casing, the cement around the casing, a and a quantity of the formation. It is desirable to penetrate as much of the formation as possible to obtain the highest yield of oil or gas. Thus, the jet formation is critical to the operation of the shaped charge. While a high density material such as tungsten gives deeper penetration into the formation, it also creates slugs that block the perforation. This is due to a re-agglomeration of the molten material instead of dispersal. By changing the constituents that make up the liner, the dynamics of the jet and slug formation can be controlled.

Figure 1:
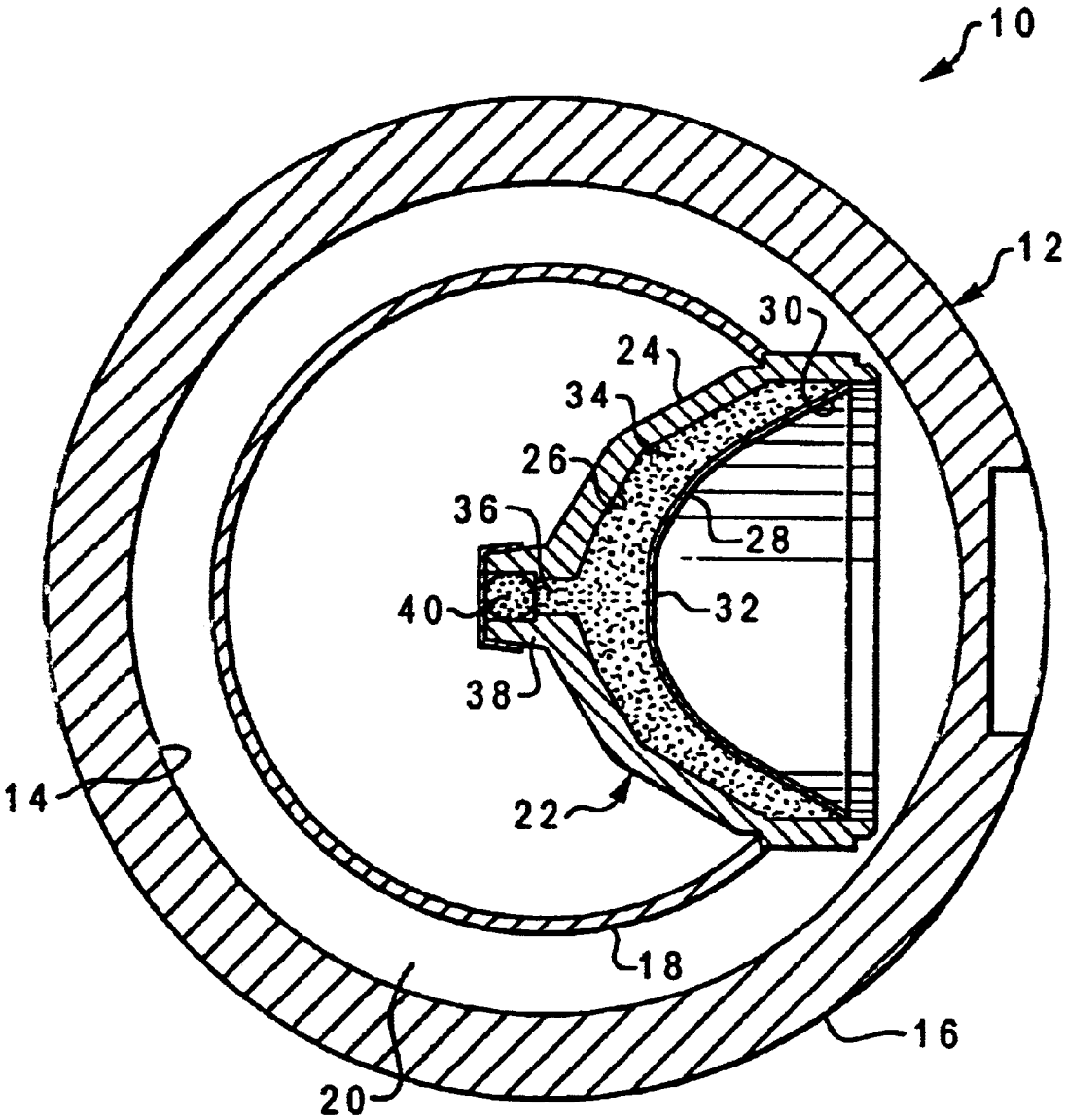
FIG. 1 is a cross-sectional view of a shaped charge within a well perforating gun assembly and showing a liner of the shaped charge.
Figure 2:
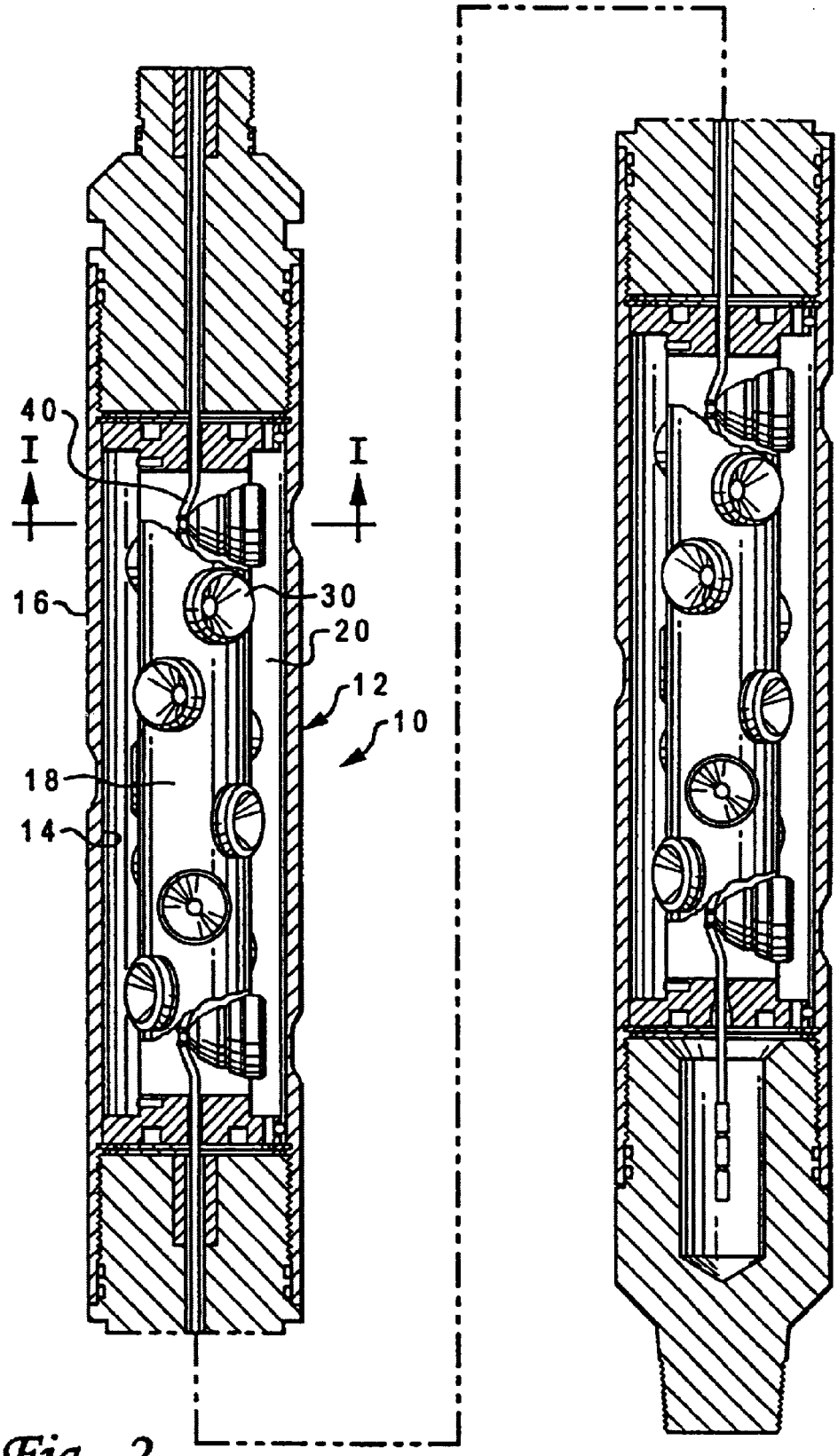
FIG. 2 is a cross-sectional side view of the perforating gun assembly from which the cross-sectional view in of FIG. 1 in taken along the lines I—I

The present invention improves the jet dynamics and slug formation of shaped-charges. Referring to FIG. 1, a transverse cross section of a perforating gun assembly is shown. FIG. 2 chows a longitudinal cross section of the perforating gun assembly 10. The perforating gun has a tubular carrier 12 having an interior cylinder wall 14 and an exterior cylindrical surface or wall 16. A cylindrical charge tube 18 is disposed within the tubular carrier 12 and is concentric with the tubular carrier 12. The outside diameter of the charge tube 18 is such that an annular space 20 is created between the outer surface of the charge tube 18 and the inner wall 14 of the carrier 12.

An explosive shaped charge 22 has a frusto-conical charge case 24. The charge case 24 is typically formed from steel, die cast aluminum, or zinc alloys and has an interior surface or wall 26 that defines a hollow interior of the charge case 24. The charge case 24 is open at the outer end and tapers inward. Disposed within the interior of the case 24 is d liner 28 having a generally conical or frusco-conical configuration. The liner 29 tapers inward from a base 30, located at the outer end, to a nose portion 32. The liner 28 is open at the base 30 and has a hollow interior. As discussed infra, the liner 28 is formed from a powdered metal matrix that is compressed under high pressure to the desired configuration and density.

Disposed between the liner 28 and interior wall 26 of the caging 24 is an explosive material 34. The explosive material 34 extends from the interior of the case 24 through channel 36 formed in the innermost end of the case 24. A pair of ears 38 extend from the channel 36 of the case 24 and receive a detonating cord 40 for detonating the explosive 34 of the shaped charge 22.

As shown in FIG. 2, a plurality of shaped charges are mounted in the charge tube 18 and the perforating gun assembly 10 is mounted within a wellbore (not shown) When the shaped charges 22 of the perforating gun assembly 10 are detonated, the liner 28 disintegrates forming a jet that penetrates through the casing (not shown) of the wellbore and into the surrounding formation to form a perforation.

As discussed previously, the liner 28 is formed from a powdered metal mixture that is compressed at high pressures to form a solid mass in the desired shape. A high density metal must be included in the mixture in order to achieve the desired effect from the explosive force. Common high density metals used include copper and tungsten, but other high density metals can also be used. The mixture of metals typically contains various other ductile metals being combined within the matrix to serve as a binder material. Other binder metals include nickel, lead, silver, gold, zinc, iron, tin, antimony, tantalum, cobalt, bronze and uranium. Powdered graphite is also commonly used and serves as lubricant during the formation of the liner.

It has been found chat the inclusion of molybdenum in the metal matrix enhances both the jet formation and density of the jet formed and retards re-agglomeration of the liner materials that form slugging or blockage of the perforation tunnel. Molybdenum has been found to have higher shock velocities than conventional constituents of the liner matrix, such as lead, copper or tungsten. With the addition of molybdenum to the mixture, the reduction or elimination of the slugging phenomenon results and a cleaner perforation is formed. Further, the higher shock velocity imparted to the charge by the addition of the molybdenum increases the overall depth of penetration of the jet.

In the present invention, molybdenum is added to the matrix and may be used to replace, in whole or in part, one of the other ductile metals otherwise used in the metal matrix. The molybdenum also allows higher amounts of tungsten to be used to achieve a higher density mixture, thus increased penetration into the formation. Another benefit of the molybdenum is that it provides lubricating effects so that the graphite lubricant typically used can be reduced or eliminated.

The liner mixture may consist of between 0.5% to 25% molybdenum, 60% to 85% tungsten, with other ductile malleable metals comprising 10% to 35%, and from 0% to 1% graphite. All percentages given are based upon the total weight of the powdered mixture. Table 1 shows the ranges percent composition of metals that may be used for the liner based on percentage by weight of the total powdered mixture.

TABLE 1

Percentage Range of Component Metals in Charge of the Invention.

| COMPONENT | PERCENTAGE |
|---|---|
| Molybdenum (Mo) | 0.5–25% |
| Copper (Cu) | 0–10% |
| Tungsten (W) | 60–85% |
| Lead (Pb) | 10–19% |
| Graphite (C) | 0–1% |

Table 2 shows representative data from tests performed on the charge of the invention as compared to other commonly used charges. These data show that the depth of penetration into the wellbore (TTP) is greatest when molybdenum is present in the metal mixture. Thus, the shaped charge of the invention (NTX liner) give the best results. As discussed above, an increase in a tungsten tends to increase slugging, which is born out in the data of Table 2. The "Western Atlas" (WA) liner having 80% tungsten had a TTP value of 18.13 inches, but a slug length of 3.38, the longest of the three example tests. Using the higher density tungsten is desirable to obtain high penetration, but results in the negative effect of forming slugs in the perforation. Further, the "NT" shaped-charges which contain only 55% tungsten had a relatively low TTP, and also a high slug length, both valued being undesirable By adding molybdenum co the metal mixture to a 15% (by weight) level, the amount of added tungsten can be increased, thus increasing the TTP, while decreasing the slug length. These data show the increased depth of bore penetration and lower slug length by using the mixture of molybdenum and tungsten of the present invention.

The data in Table 2 also indicate that using molybdenum may also improve the shock velocity of the liner This is indicated by the 19.57 TTP value, being larger than even the WA value which contains more tungsten. An increase in the shock velocity of the liner will improve the depth of penetration of the jet into the surrounding formation, thus improving the performance of the shaped-charge.

TABLE 2

Comparison of Liner Performance of Present Invention with Other Shaped-Charges.

| Liner Type | Percent Tungsten | TTP (inches) | Slug Length (inches) |
|---|---|---|---|
| NT | 55% | 17.60 | 2.75 |
| NT | 55% | 15.20 | 4.70 |
| NT | 55% | 17.60 | 2.60 |
| NT | 55% | 18.20 | 3.75 |
| NT | 55% | 15.80 | 2.20 |
| NT | 55% | 16.90 | 2.80 |
| | Averages | 16.88 | 3.13 |
| NTX (15% Mo) | 70% | 20.00 | 2.75 |
| NTX (15% Mo) | 70% | 19.25 | 2.25 |
| NTX (15% Mo) | 70% | 19.50 | 0.00 |
| NTX (15% Mo) | 70% | 19.00 | 3.00 |
| NTX (15% Mo) | 70% | 19.38 | 2.00 |
| NTX (15% Mo) | 70% | 20.30 | 2.20 |
| | Averages | 19.57 | 2.03 |
| WA | 80% | 17.50 | 4.50 |
| WA | 80% | 20.50 | 3.25 |
| WA | 80% | 18.00 | 4.25 |
| WA | 80% | 17.25 | 3.50 |
| WA | 80% | 16.75 | 1.25 |

TABLE 2-continued

Comparison of Liner Performance of Present Invention with Other Shaped-Charges.

| Liner Type | Percent Tungsten | TTP (inches) | Slug Length (inches) |
|---|---|---|---|
| WA | 80% | 18.80 | 3.50 |
| | Averages | 18.13 | 3.38 |

The shaped charge liner has several advantages over the prior art. The inclusion of molybdenum in the liner matrix allows materials to be used that create a higher density liner to achieve deeper penetration yet reduces slugging and re-agglomeration effects that are undesirable in many applications.

The present invention allows for deeper penetration of the jet of a shaped charge into the formation due to the higher shock velocity imparted to the charge by the molybdenum, thus improving the oil or gas yield in an operation.

The molybdenum containing lining of the invention also provides lubricating effects during the formation of the liners thus decreasing the need for graphite in the metal mixture.

Although the invention has been described with reference to a specific embodiment, this description is not meant to be construed in a limiting sense. Various modification of the disclosed embodiment as well as alternative embodiments of the invention will become apparent to persons skilled in the art upon reference to the description of the invention. While the invention has been shown in only one of its forms, it is not thus limited but is susceptible to various changes and modifications without departing from the spirit thereof.

What is claimed is:

1. A perforating gun, comprising:

(a) a tubular carrier;

(b) a charge tube disposed within said tubular carrier;

(c) at least one shaped charge mounted in said charge tube, said shaped charge comprising:

(i) a casing;

(ii) a liner associated with said casing, said liner formed from a powdered metal mixture containing molybdenum and a second material, the amount of molybdenum making up between about 0.5% to 25% by weight of said metal mixture; and (iii) an explosive material disposed within said casing.

2. The perforating gun of claim 1 wherein said molybdenum is in an amount that reduces the re-agglomeration of said second material.

3. The perforating gun of claim 1 wherein said metal mixture is compressed at high-pressure to form a solid mass.

4. The perforating gun of claim 3 wherein said molybdenum is in an amount that provides lubrication during the compression of said metal mixture.

5. The perforating gun of claim 1, wherein said molybdenum is in an amount that increases the shock velocity of said liner.

6. The perforating gun of claim 1, wherein said second material comprises tungsten.

7. The perforating gun of claim 1, wherein said metal mixture of said liner is formed into a generally conical configuration.

8. A method of perforating a well, comprising:

(a) providing a tubular carrier;

(b) disposing a charge tube within the tubular carrier;

(c) mounting at least one shaped charge in the charge tube, the shaped charge comprising:

(i) a casing;

(ii) a liner associated with said casing, said liner formed from a powdered metal mixture containing molybdenum and a second material, the amount of molybdenum making up between about 0.5% to 25% by weight of said metal mixture; and (iii) an explosive material disposed within said casing.

9. The method of claim 8, wherein said molybdenum is in an amount that reduces the re-agglomeration of said second material.

10. The method of claim 8, wherein said metal mixture is compressed at high-pressure to form a solid mass.

11. The method of claim 10, wherein said molybdenum is in an amount that provides lubrication during the compression of said metal mixture.

12. The method of claim 8, wherein said molybdenum is in an amount that increases the shock velocity of said liner.

13. The method of claim 8, wherein said second material comprises tungsten.

14. The method of claim 8, wherein said metal mixture of said liner is formed into a generally conical configuration.

15. The method of claim 8, further comprising positioning the tubular carrier in a well; and detonating the shaped charge.

* * * * *